United States Patent [19]

Yunan

[11] Patent Number: 4,481,884

[45] Date of Patent: Nov. 13, 1984

[54] FIELD-CONNECTED EXPLOSIVE BOOSTER FOR INITIATING LOW-ENERGY EXPLOSIVE CONNECTING CORDS

[75] Inventor: Malak E. Yunan, Boonton Township, Morris County, N.J.

[73] Assignee: E. I. Du Pont de Nemours and Company, Wilmington, Del.

[21] Appl. No.: 334,889

[22] Filed: Dec. 28, 1981

[51] Int. Cl.[3] ..... F42B 3/00

[52] U.S. Cl. ..... 102/313; 102/275.5; 102/275.4; 102/292; 102/275.8; 102/312; 102/275.7; 102/318; 102/275.12; 102/322

[58] Field of Search ..... 102/275.4, 275.6, 275.8, 102/275.11, 275.12, 311, 312, 313, 318, 322, 317, 200, 275.5, 275.7, 292

[56] References Cited

U.S. PATENT DOCUMENTS

| | | | |
|---|---|---|---|
| 932,701 | 8/1909 | Harle | 102/275.4 |
| 3,175,491 | 3/1965 | Robertson | 102/275.7 |
| 3,288,065 | 11/1966 | Tousley, Jr. | 102/318 |
| 3,878,785 | 4/1975 | Lundborg | 102/275.4 |
| 3,991,679 | 11/1976 | Savitt et al. | 102/275.4 |
| 4,232,606 | 11/1980 | Yunan | 102/275.8 |
| 4,248,152 | 2/1981 | Yunan . | |
| 4,369,688 | 1/1983 | Yunan | 102/275.8 X |

FOREIGN PATENT DOCUMENTS

| | | | |
|---|---|---|---|
| 24419 | 9/1935 | Australia | 102/275.12 |
| 60864 | 4/1902 | France | 102/275.4 |
| 607712 | 9/1948 | United Kingdom | 102/275.7 |
| 726295 | 3/1955 | United Kingdom | 102/275.7 |

OTHER PUBLICATIONS

Blasters' Handbook, E. I. du Pont de Nemours & Co., (Inc.), Wilmington, Delaware, 1977, pp. 107–108.

*Primary Examiner*—Peter A. Nelson

[57] ABSTRACT

An explosive booster, useful as a starter for one or more low-energy explosive connecting cords, e.g., low-energy detonating cord (LEDC), comprises a detonating explosive charge in the form of a rod having at least one longitudinal perforation for threading one or more (receiver) cords to be initiated by the booster explosive charge, which in turn is initiated by a blasting cap or preferably by the side-output of a (donor) detonating cord in contact therewith. A preferred rod has multiple perforations for threading multiple receiver cords, and is housed within a rigid plastic connector having a portion of its wall circumferentially cut out to allow a donor cord to contact the thereby-exposed rod therein. A trunkline cord is thereby adapted to initiate multiple downlines via a single booster.

14 Claims, 5 Drawing Figures

FIELD-CONNECTED EXPLOSIVE BOOSTER FOR INITIATING LOW-ENERGY EXPLOSIVE CONNECTING CORDS

BACKGROUND OF THE INVENTION

1. Field of the Invention

The present invention relates to an explosive booster for initiating a propagative explosion in a low-energy explosive connecting cord, e.g., for transmitting a detonation from a donor detonating cord to a receiver low-energy detonating cord; and to an assembly containing said booster in combination with a trunkline and a downline for initiating an explosive charge in a borehole.

2. Description of the Prior Art

Explosive connecting cords are used in non-electric blasting systems to convey or conduct an initiating impulse, i.e., a detonation or deflagration pressure wave, to an explosive charge in a borehole from a remote area. One type of connecting cord used to transmit a detonation impulse is low-energy detonating cord (LEDC), which can be used as a trunkline and/or a downline cord to transmit the impulse to a non-electric blasting cap positioned in the charge in the hole.

One type of LEDC which has recently been developed is described in U.S. Pat. No. 4,232,606. This cord has, enclosed within a plastic sheath, a continuous solid core of a deformable bonded detonating explosive composition comprising a crystalline high explosive compound, e.g., superfine pentaerythritol tetranitrate (PETN), admixed with a binding agent, the crystalline high explosive loading being about from 0.1 to 2 grams per meter of length. Another type of LEDC, described in U.S. Pat. No. 3,125,024, has a core of granular PETN having a specific surface of 900–3400 $cm^2/g$ confined within a woven textile sheath surrounded by a protective covering such as a thermoplastic layer. In addition, a currently available explosive connecting cord which propagates a shock or percussion wave consists of a plastic tube coated on the inside with a thin layer of an explosive substance such as PETN, RDX, or HMX powder (U.S. Pat. No. 3,590,739).

In blasting practice, lengths of explosive connecting cords must be joined to other lengths of the same or different cords, e.g., in the joining of downlines to a trunkline, and the explosion must be transmitted from one cord to the other. Depending on its structure and composition, a low-energy receiver cord may or may not be able to "pick up", i.e., to detonate or deflagrate as the case may be, from the detonation of a donor cord with which it is spliced or knotted.

U.S Pat. No. 4,248,152, issued Feb. 3, 1981, describes an explosive booster adapted to be used with LEDC to permit the latter to reliably initiate, or be initiated by, another detonating cord. This booster contains a granular explosive charge, e.g., PETN, between the walls and closed bottoms of inner and outer shells, one cord being held in an axial cavity in the inner shell in a manner such that an end-portion of the cord is surrounded by the booster explosive, and another cord being positioned transversely outside and adjacent the closed end of the outer shell. One of the cords (donor) initiates the booster explosive and this in turn initiates the other cord (receiver), which usually is LEDC. Cord-gripping means for holding the cord in the inner shell's cavity is shown. The booster is capable of transmitting a detonation from a trunkline to a single downline.

SUMMARY OF THE INVENTION

The present invention provides an improved explosive booster for initiating a propagative explosion in at least one low-energy explosive connecting cord comprised of a linear charge of explosive surrounded by a protective sheath, which booster comprises a detonating explosive charge in the form of a rod provided with at least one perforation extending through the entire length, and substantially parallel to the longitudinal axis, thereof for threading the low-energy explosive connecting cord(s) through, and for enclosing a section of said low-energy cord(s) within, said rod, said booster explosive charge being adapted (a) to be detonated by a blasting cap or, preferably, by the sideoutput of a detonating cord, in contact therewith, and (b) to apply an initiation impulse to the linear explosive charge in the section(s) of low-energy connecting cord enclosed within said rod for the propagation of an explosion through said low-energy cord(s).

In a preferred booster of the invention, the booster explosive charge in the form of a rod is provided with two or more of the described perforations for threading with two or more low-energy explosive connecting cords, each in a different perforation, the sections of the cords which are enclosed within the rod being adapted thereby to be separated from one another and surrounded by the booster explosive. In this embodiment, the initiation impulse is applied substantially simultaneously to the linear explosive charge in each of the sections of the cords enclosed in the booster.

The physical strength of the booster explosive charge in rod form depends on the composition from which it is formed. Although packaging may not be needed in those instances in which the charge is per se highly crush-and fracture-resistant, in most cases the charge will be nested within a rigid container, preferably a plastic tube having plastic end closures provided with one or more apertures aligned with, and of substantially the same size as, the perforation(s) in the booster charge. Although one or both of the end closures can be separate from the tubular portion of the container and affixed thereto after the booster charge has been positioned therein, a preferred container has an end closure which is adapted to be opened for the placement of the booster charge therein, and subsequently closed. A connector for joining a detonating cord trunkline to the booster comprises this rigid tube container having a circumferential cutout portion or slot in its wall extending for at least about one-quarter of the circumference of the tube to allow a trunkline cord to contact the thereby-exposed booster explosive charge therein.

When used in blasting assemblies to initiate multiple downlines, the present booster has the advantage that a number of downlines can be initiated per booster. Also, the downlines can be conveniently attached to the booster in the field merely by threading the lines through the perforations; and knotting or tying the cords to keep them in place in the booster.

BRIEF DESCRIPTION OF THE DRAWING

In the accompanying drawing, which illustrates specific embodiments of the explosive booster, boostercord connector, and trunkline-booster-downline assembly of this invention, as well as the use of the assembly for initiating explosive charges in boreholes.

DETAILED DESCRIPTION

Figure 1:
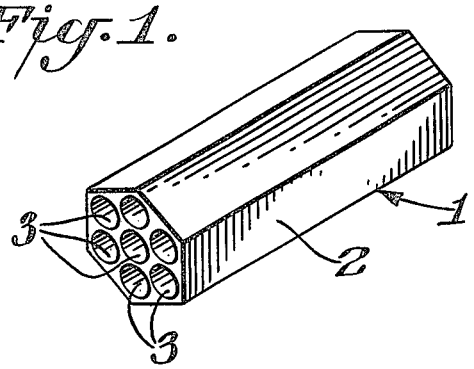
FIG. 1 is a perspective view of a multicord explosive booster of the invention.

The multicord booster shown in FIG. 1, and denoted by the numeral 1, consists of a mass of self-supporting detonating explosive in the form of a rod 2, which in this instance is an hexagonal prism, having hexagonal bases perpendicular to its altitude. Explosive rod 2 is provided with seven circular perforations 3, all of substantially the same diameter, which extend through the entire length of rod 2 and are substantially parallel to its longitudinal axis (altitude of the prism). One of the perforations 3 is centered on the longitudinal axis of rod 2, and the other six are centered on the circumference of a circle near the edge of the hexagonal cross-section, equally spaced from one another, one at each of the six angles of the hexagon.

Figure 2C:
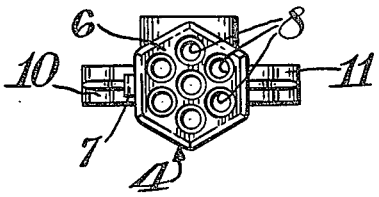
FIGS. 2A, 2B, and 2C are front and side elevations and a plan view, respectively, of an assembly wherein the booster shown in FIG. 1 is positioned in a connector of the invention for joining a trunkline to the booster.
Figure 2A:
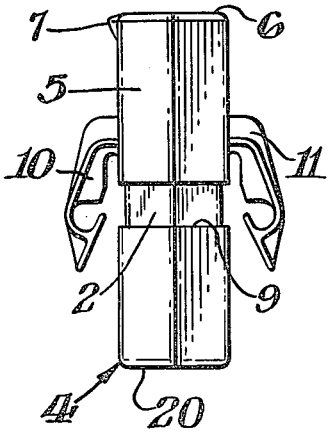
Figure 2B:
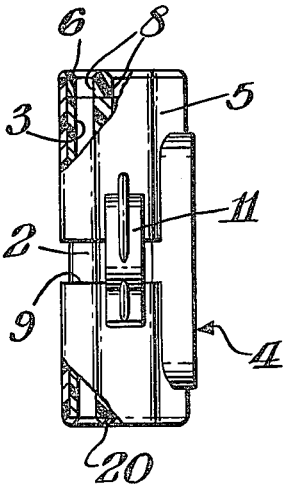

The connector 4 shown in FIGS. 2A, 2B, and 2C has a tubular body 5 of hexagonal cross-section and so dimensioned that it is capable of accommodating booster 1. Tubular body 5 is made of rigid plastic material and has one end closure 20 which forms a unitary shell or capsule with tubular body 5. At the other end is an end-closure or lid 6 attached to tubular body 5 by hinge 7. When open, lid 6 permits booster 1 to be placed inside tubular body 5. When closed, lid 6 forms the second closed end on tubular body 5, thereby providing booster 1 with end as well as peripheral protection. Lid 6 has seven apertures 8, which are sized and spaced substantially the same as perforations 3 in booster 1. Likewise, the unitary end closure 20 has seven apertures identical to those in lid 6, and coaxial therewith.

Tubular body 5 has a strip-like circumferential open portion or slot 9 cut through its wall extending around four sides of the hexagon, with the remaining two sides left intact. In this case, slot 9 is located approximately midway between the ends of tubular body 5. Gripping means 10 and 11 are affixed to the outside wall of tubular body 5 at diametrically opposed locations thereon. Slot 9 is adapted to receive a detonating cord circumferentially, and gripping means 10 and 11 are adapted to maintain said cord in slot 9, as is shown in FIG. 3.

Figure 3:
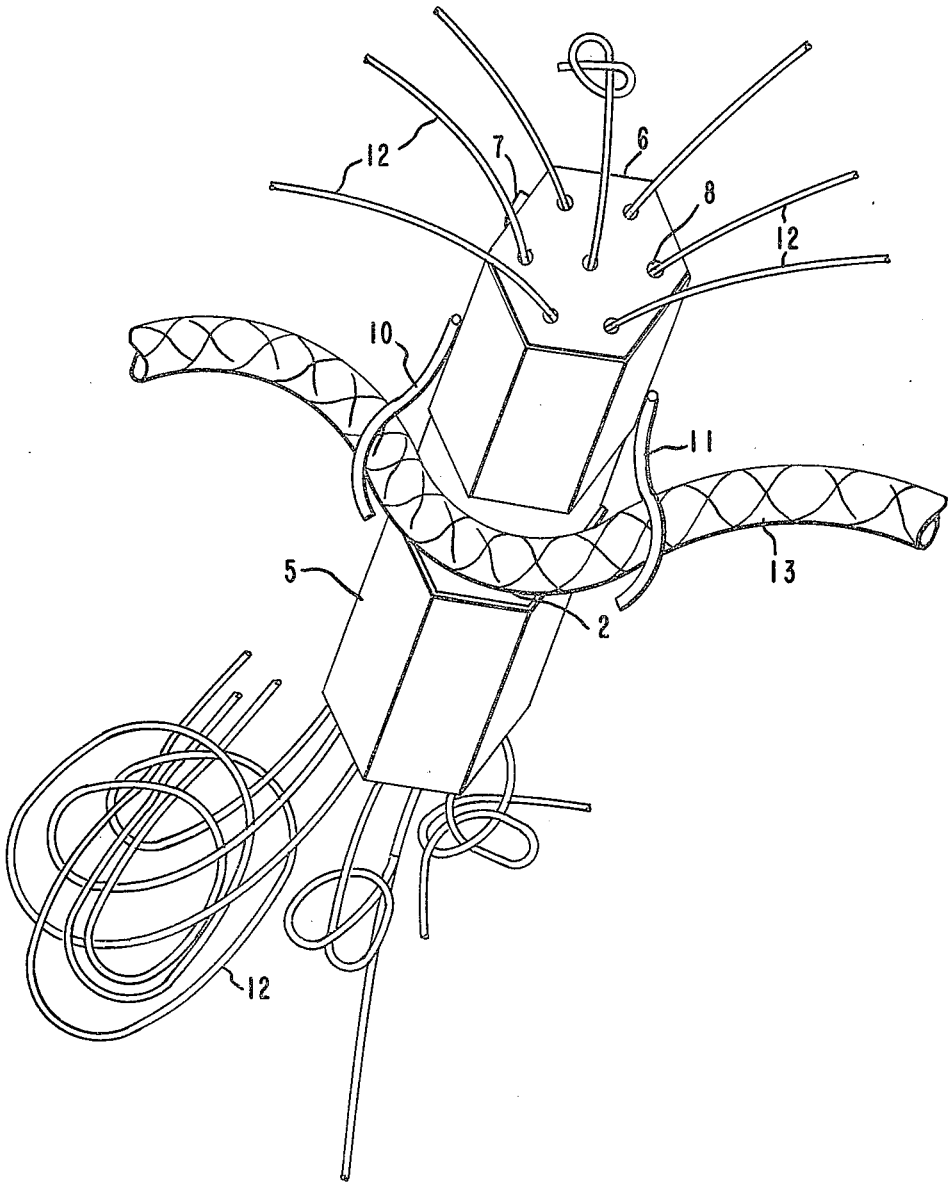
FIG. 3 is a perspective view of an assembly wherein a trunkline cord and multiple downline cords are attached to the booster shown in FIG. 1, the latter being positioned in a connector which is substantially that shown in FIGS. 2A, 2B, and 2C.

In FIG. 3, the booster of FIG. 1 is nested within the connector of FIGS. 2A, 2B, and 2C, which in this case has gripping means 10 and 11 of slightly different design. By virtue of the hexagonal configuration of booster 1 and the connector's end closures, and the location of perforations 3 and apertures 8 at the center and at each of the hexagonal angles, the booster's perforations and the apertures on the end closures of the connector are automatically in register when the booster is inserted into the connector.

One low-energy explosive connecting cord 12 is threaded through each of the seven perforations 3. Each of the cords 12 has one free end for connection in a borehole, and one end knotted, tied, or looped to prevent it from slipping out of the booster. A detonating cord 13, e.g., Primacord®, fits into slot 9 in a manner such that its side is in contact with rod 2, and is held there by gripping means 10 and 11.

Figure 4:
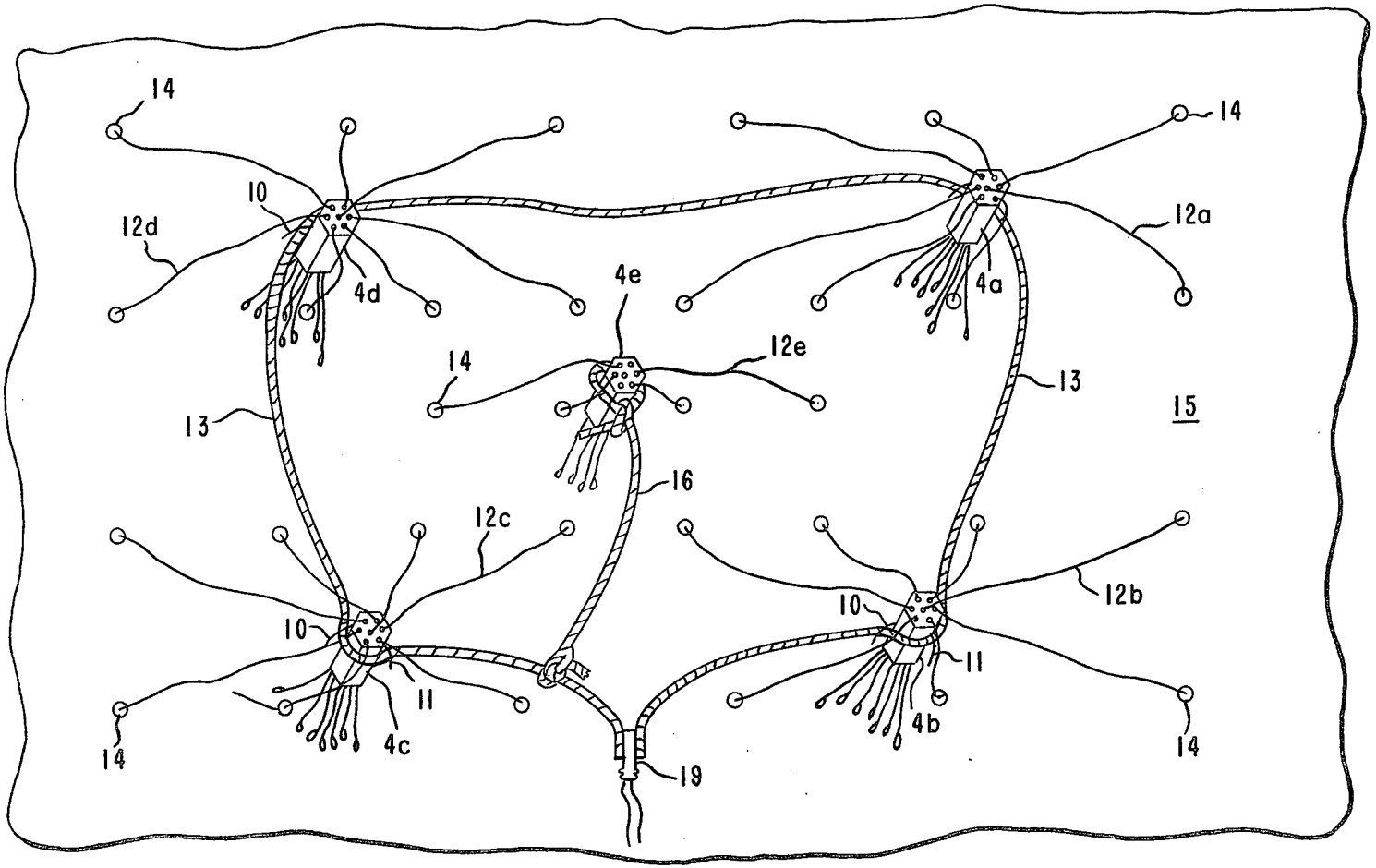
FIG. 4 is a schematic representation of a mine face to be blasted with multiple explosive connecting cord downlines initiated by a trunkline via the multicord booster shown in FIG. 1.

In FIG. 4, 32 boreholes 14 are drilled into mine face 15. The boreholes contain explosive charges which are to be initiated non-electrically, i.e., without the use of electric blasting caps in the holes. To accomplish this, a low-energy explosive connecting cord leads to the charge in the hole, more specifically to a non-electric blasting cap positioned in the charge. All of these cords, known as downlines, receive their initiating impulse from a detonating cord 13, known as a trunkline, located at the face. In the case shown, the downlines are "started", i.e., receive an initiating impulse which is "boosted", by means of the booster shown in FIG. 1, held in the connector substantially as shown in FIG. 2. Five boosters (i.e.,starters) are employed to initiate 32 downlines. The boosters in connectors 4*a*, 4*b*, 4*c*, and 4*d* are threaded with seven downlines each, i.e., 12*a*, 12*b*, 12*c*, and 12*d*, respectively, while the booster in connector 4*e* is threaded with four downlines 12*e*. A continuous length of trunkline 13 is gripped by gripping means 10 and 11 in connectors 4*a*, 4*b*, 4*c*, and 4*d* in a manner such that the trunkline is held in slot 9 with its side in contact with the exposed explosive rod 2. The end portions of this length of trunkline are connected to electric blasting cap 19. A second length of trunkline cord 16 has one end tied around cord 13, and the other tied around connector 4*e*. Cord 16 is a type of cord which is capable of being initiated directly by the detonation of cord 13. In connector 4*e*, cord 13 is tied in place in slot 9, and gripping means 10 and 11 are omitted.

The actuation of blasting cap 19 initiates trunklines 13 and 16, which in turn initiate the five boosters and 32 downlines.

The present invention is based on the discovery that a perforated rod of detonating explosive can reliably transmit a laterally applied initiation impulse to a sheathed linear explosive charge in a low-energy explosive connecting cord threaded through the rod. In its broadest sense, the booster of the invention can have a single perforation therein for the threading of a single cord therethrough. This booster is useful in situations in which the borehole spacings are so great that the running of multiple downlines through a single booster may become prohibitively expensive owing to the longer lengths of downline needed on the surface in contrast to those consumed when a booster is used for each downline.

For the initiation of multiple low-energy connecting cords, the booster can have a single perforation properly sized to accommodate two or more downlines. Even insensitive explosive connecting cords such as the low-energy detonating cord of U.S. Pat. No. 4,232,606 can be initiated simultaneously when threaded through a single-perforation booster of the invention, despite the insensitivity of the cord's explosive core and the layers of inert sheath materials between the explosive cores of adjacent cords. However, the maximum degree of reliability of initiation of multiple cords by a single booster, with no theoretical limitation on the number of cords which it is possible to initiate per booster, is obtained with a booster which has each cord threaded through a separate perforation, and a multi-perforation booster therefore is preferred. In this embodiment, the booster explosive is present between adjacent sections of cord enclosed in the perforations.

The booster is made by forming a detonating explosive charge into a rod. The term "rod" as used herein to describe the form of the booster explosive charge denotes a solid body such as a cylinder (circular or elliptical) or prism having any convenient cross-section and an altitude preferably greater than the length of the longest straight line joining opposite points on its base, e.g., the diameter of a circular base or the length of a line connecting the apexes of opposite angles of an hexagonal base. Preferably, the altitude of the cylinder or prism is substantially perpendicular to the bases. The prism also may be a parallelopiped, e.g., as it is in the case of a sheet or laminate, in the sense that the bases of the prism can be parallelograms which are small in width compared to length. The "longitudinal axis" of the cylinder or prism to which the perforation(s) therein are substantially parallel is an axis which is parallel to the altitude of the cylinder or prism. In the case of the parallelopiped type of prism, the "longitudinal axis" can be any axis which is perpendicular to the altitude of the parallelopiped, e.g., to the thickness of a sheet.

For reasons of ease of manufacture, handling, and packaging (if required), preferred boosters are substantially equidimensional in cross-section, e.g., as in a cylinder, or a square or hexagonal prism. As was mentioned previously, the hexagonal prism perforated as shown in FIG. 1 permits automatic alignment of the perforations with apertures in hexagonal end closures on a container for the booster, and for this reason the hexagonal prism may be preferred.

The explosive charge in the booster is a detonating explosive composition, preferably one which results in a velocity of detonation of the booster of at least about 6000 meters per second. The explosive composition can be in the form of a molded or pressed powder, a cast body, or a mass of a deformable or rigid bonded explosive. Regardless of the nature of the composition, suitable containment to enable the booster to withstand the rigors of such operations as handling, threading, etc. to which it is subjected in use, preferably rigid containment, usually will be employed. A container also can be employed to protect the booster from moisture, if necessary. A tubular shell of rigid plastic material, dimensioned and shaped to accommodate the explosive rod, and preferably adapted to be closed at both ends, is suitable. A booster in the form of a rod of pressed powder, e.g., PETN powder, can be formed by loading such a shell with the powder and applying pressure thereto to achieve a required density. If a container is required for a molded powder, e.g., a mixture of 97.5% PETN and 2.5% wax, or a cast composition, such as a RDX/TNT mixture, the booster can be formed directly in the container, or in a separate mold with subsequent transferral to the container.

A preferred explosive charge for use in making the booster of this invention is a deformable bonded detonating explosive composition comprising at least one cap-sensitive crystalline high explosive compound admixed with a binding agent, e.g., an organic polymeric composition. Such a bonded composition can be readily formed into a rod with one or more longitudinal perforations therethrough by extrusion techniques. Preferably, the crystalline high explosive component of this composition is an organic polynitrate, most preferably PETN, or polynitramine, e.g., RDX (cyclotrimethylenetrinitramine) or HMX (cyclotetramethylenetetranitramine). The crystalline high explosive compound should be in the "superfine" particle size range, i.e., the maximum dimension of the particles should be in the range of about from 0.1 to 50 microns, and generally the average maximum dimension should be no greater than about 20 microns. A preferred crystalline high explosive for use in the bonded explosive composition is one having microholes, as made by the process described in U.S. Pat. No. 3,754,061, the disclosure of which is incorporated herein by reference. The binding agent can be a natural or synthetic organic polymer, e.g., the soluble nitrocellulose described in U.S. Pat. No. 2,992,087, or the mixture of an organic rubber and a thermoplastic terpene hydrocarbon resin described in U.S. Pat. No. 2,999,743. Other ingredients also may be present in the bonded explosive composition, e.g., additives used for plasticizing the binder or densifying the composition.

The crystalline high explosive content of the bonded composition can vary, e.g., from about 55 percent up to about 95 percent by weight. Within this range, detonation of the booster explosive charge by the side-output of a donor detonating cord (trunkline) requires a higher explosive content of the bonded composition with lower-energy donor cords. For example, when the donor cord is Primacord®, e.g., when the donor cord has a PETN loading of at least about 5 grams per meter of length, a bonded booster explosive composition containing about from 55 to 80 percent PETN can be employed. With a low-energy donor detonating cord, e.g., the 1.5 g/m cord having a 1.3-mm-diameter explosive core described in Example 2 of U.S. Pat. No. 4,232,606, the bonded booster explosive composition should contain at least about 95 percent PETN. Other booster explosive compositions which are especially useful with low-energy donor detonating cords are pressed powders, e.g., 100 percent PETN, and molded powders, e.g., 97.5% PETN/2.5% wax.

The donor cord can be in contact with all or part of the booster's circumference (as is shown in FIGS. 3 and 4), or all or part of an end surface (as is described in Example 3 which follows).

Figure 5:
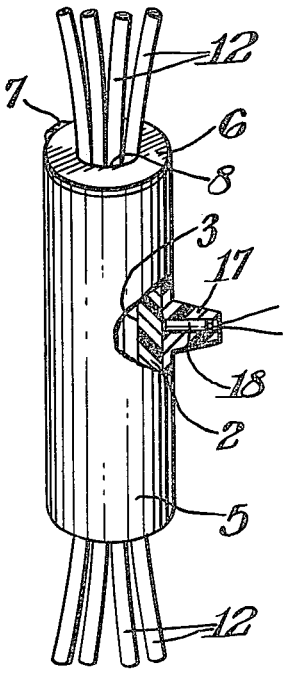
FIG. 5 is a perspective view in partial cross-section of an assembly of this invention wherein a blasting cap and multiple downline cords are attached to a different multi-cord booster of the invention, the latter being positioned in a tubular container having means for joining a blasting cap to the booster.

The explosive booster of the invention also provides a means of initiating low-energy explosive connecting cords by means of an electric or non-electric blasting cap. The cap should be held in position with its base charge end in contact with the side of the booster explosive charge, e.g., by suitable taping directly to the surface of the explosive rod, or by a cap-holding means on a container for the rod, as is shown in FIG. 5. In FIG. 5, 17 is an axially perforated frustoconical member whose side wall is integral with the wall of tubular container body 5. The axial perforation in member 17 is adapted to grip and hold electric blasting cap 18. The base of cap 18 contacts the sidewall of booster explosive 2. In this assembly, explosive rod 2 is a cylinder, and tubular body 5 has a circular cross-section. Rod 2 has a single axial perforation 3 sized to accommodate four downlines 12.

The following examples illustrate specific embodiments of the booster and booster/cord assembly of the invention.

EXAMPLE 1

The following procedure was used to make booster 1 shown in FIG. 1:

A mass of deformable bonded explosive composition consisting of a mixture of 75% superfine PETN, 21% acetyl tributyl citrate, and 4% nitrocellulose was prepared by the procedure described in U.S. Pat. No. 2,992,087. The superfine PETN was of the type which contains dispersed microholes prepared by the method discribed in U.S. Pat. No. 3,754,061, and had an average particle size of less than 15 microns, with all particles smaller than 44 microns. The mass of bonded explosive was extruded through an hexagonal orifice around seven pins mounted therein. This produced an hexagonal rod or prism of explosive measuring 16.5 mm between opposite points of the hexagon, with seven perforations 3.2 mm in diameter The six outer perforations were centered on the circumference of a circle 11.4 mm in diameter. The explosive rod was cut into shorter rods or grommets (2) 5.1 cm long.

Each of the seven perforations 3 in explosive rod 2 was threaded with a separate length, each approximately 1.5 meters, of cord made as described in Example 1 of U.S. Pat. No. 4,232,606, the disclosure of which patent is incorporated herein by reference. This cord had an outer diameter of 2.5 mm, a 0.8-mm-diameter core of the same bonded explosive composition used to prepare the explosive rod, six longitudinal core-reinforcing strands of polyethylene terephthalate yarn distributed about the core, and a 0.9-mm-thick low-density polyethylene sheath surrounding the core and strands. The PETN loading in the core was 0.5 g/m. The explosive rod was located at about the center of each length of threaded cord.

A 30.5-cm-long, 0.4-cm-diameter piece of a high-energy detonating cord known as E-Cord® (manufactured by The Ensign-Bickford Company), having a 5.3 g/m PETN core encased in textile braid followed by a plastic jacket, then outer textile yarns crosscountered in a close weave, was wrapped around the middle of explosive rod 2 and tied in a manner such that the cord (13) made intimate contact with three sides of the hexagon. About a 25.4 cm length of the E-Cord® extended beyond the rod. The E-Cord® was trunkline cord 13, and the low-energy cords were downlines 12.

The free end of the E-Cord® was initiated by an electric blasting cap. This caused booster 1 to detonate, which in turn caused the detonation of all seven downlines in both directions.

EXAMPLE 2

Boosters were made as described in Example 1 except that rod 2 was a cylinder having an outer diameter of 10 mm and a single 5.6-mm-diameter axial perforation. Three downlines 12 were threaded through the rod. The E-Cord® initiated the booster, and in turn all three downlines in both directions.

EXAMPLE 3

A booster was made of pressed granular PETN as follows:

A polyethylene shell having a wall thickness of 0.5 mm and an internal diameter of 6.4 mm was positioned coaxially within a polyethylene shell having the same wall thickness and an outer diameter of 15.9 mm. The bottom of the inner shell and the adjacent portion of the bottom of the outer shell were punched out leaving a 6.4-mm-diameter axial perforation through the assembly. Loaded first into the annulus between the shell walls was 0.3 gram of the superfine PETN described in Example 1, followed by 2.6 grams of cap-grade PETN. The powder was pressed at about 1330 Newtons. Four lengths of LEDC receiver cords were threaded through the perforation in the shell assembly. These cords were the same 0.5 g/m cords as those threaded through the booster as described in Example 1.

The donor cord was of the type described as a trunkline in Example 2 of U.S. Pat. No. 4,232,606. The diameter of the explosive core was 1.3 mm, and the PETN loading was 1.5 g/m. The donor cord was positioned with its side abutting the closed end of the polyethylene shell assembly, i.e., extending from the outside wall of the outer shell to the perforation. Detonation of the donor cord caused the booster and all four receiver cords to detonate.

The above examples show boosters having as many as seven perforations therethrough, and booster/cord assemblies containing as many as seven downline cords per booster. However, within limits of practicality relative to a given set of field conditions, any desired number of downlines can be initiated by a single booster having one perforation per downline. In this preferred embodiment, booster explosive surrounds each cord, forming a continuous matrix from the initiation point or line on the side surface of the explosive rod to the innermost perforation(s), thereby forming a continuous path for the detonation front between cord(s). In the multicord booster having a single perforation, the number of downlines which can be initiated by a single booster is limited, and depends on the size of the booster, the booster explosive used, and the sensitivity of the downline cords. In this embodiment, more cords of a given sensitivity can be initiated with larger and/or more powerful boosters The present booster is adapted to initiate a low-energy explosive connecting cord, i.e., to cause a detonation or a deflagration of the explosive charge in the cord which propagates through the cord. Depending on the particular explosive charge in the cord, and its loading (i.e., weight per unit of length), the explosion propagated through the cord will be a detonation or a deflagration. The explosive in the cord is in the form of a linear charge, either a continuous solid core or a coherent tubular layer.

I claim:

1. An explosive booster for initiating a propagative explosion in at least one low-energy explosive connecting cord comprised of a linear charge of explosive surrounded by a protective sheath, said booster comprising a detonating explosive charge in the form of a rod provided with at least one perforation extending through the entire length, and substantially parallel to the longitudinal axis, thereof for threading said low-energy explosive connecting cord(s) through, and for enclosing a section of said low-energy cord(s) within, said rod, said booster explosive charge being adapted (a) to be detonated by a blasting cap or by the side-output of a detonating cord in contact therewith, and (b) to apply an initiation impulse to the linear explosive charge in the section(s) of low-energy connecting cord enclosed within said rod for the propagation of an explosion through said low-energy cord(s).

2. An explosive booster of claim 1 wherein said rod is provided with a single axial perforation for threading a plurality of said low-energy connecting cords through, and for enclosing a section of each of said low-energy connecting cords within, said rod, the size of said perforation being such as to adapt said cords to be accommodated in said enclosed sections, and said booster explosive charge being adapted to apply an initiation impulse substantially simultaneously to the linear explosive charge in each of said enclosed sections.

3. An explosive booster for initiating a propagative explosion substantially simultaneously in a plurality of low-energy explosive connecting cords each comprised of a linear charge of explosive surrounded by a protective sheath, said booster comprising a detonating explosive charge in the form of a rod provided with a plurality of perforations extending through the entire length, and substantially parallel to the longitudinal axis, thereof for threading a plurality of said low-energy connecting cords through said rod, each cord in a different perforation, and for enclosing a section of each of said low-energy connecting cords within said rod, said plurality of perforations being adapted to separate said cords from one another and to permit said cords to be surrounded by said booster explosive charge in said enclosed sections, and said booster explosive charge being adapted (a) to be detonated by a blasting cap, or by the side-output of a detonating cord, in contact therewith, and (b) to apply an initiation impulse substantially simultaneously to the linear explosive charge in each of the sections of low-energy connecting cord enclosed within said rod.

4. An explosive booster of claim 1, 2, or 3 wherein said booster explosive is a deformable bonded detonating explosive comprising a cap-sensitive crystalline high explosive compound selected from the group consisting of organic polynitrates and polynitramines admixed with a binding agent.

5. An explosive booster of claim 4 wherein said binding agent is plasticized nitrocellulose and said cap-sensitive crystalline high explosive compound constitutes at least about 55 percent by weight of said deformable bonded detonating explosive.

6. An explosive booster of claim 1 wherein said booster explosive charge is nested within a rigid container comprising a plastic tube having plastic end closures provided with one or more apertures therein coaxial with, and having substantially the same diameter as, the perforation(s) in said booster explosive charge, at least one of said end closures being a lid which can be moved into the closed position after the booster explosive charge has been positioned in the container.

7. A non-electric assembly for initiating explosive charges in boreholes, said assembly comprising (a) a detonating cord trunkline;

(b) a plurality of explosive boosters according to claim 1, each of said boosters comprising a detonating explosive in the form of a rod provided with a single axial perforation, the side of said trunkline cord being in contact with the side or end surface of said rod of explosive in each of said boosters; and (c) a plurality of low-energy explosive connecting cords each comprised of a linear charge of explosive surrounded by a protective sheath, each of said cords (1) being threaded singly through one of said rods, (2) having a section enclosed within said rod in the single perforation therein, and (3) leading to an explosive charge in a borehole.

8. A non-electric assembly for initiating explosive charges in boreholes, said assembly comprising (a) a detonating cord trunkline;

(b) at least one explosive booster according to claim 2, the side of said trunkline cord being in contact with the side or end surface of said rod of explosive in each of said boosters; and (c) a plurality of low-energy explosive connecting cords each comprised of a linear charge of explosive surrounded by a protective sheath, said low-energy cords being jointly threaded through said rod(s), each of said low-energy cords (1) having a section enclosed within said rod(s) in the single perforation therein and (2) leading to an explosive charge in a borehole.

9. A non-electric assembly for initiating explosive charges in boreholes, said assembly comprising (a) a detonating cord trunkline;

(b) at least one explosive booster according to claim 3, the side of said trunkline cord being in contact with the side or end surface of said rod of explosive in each of said boosters; and (c) a plurality of low-energy explosive connecting cords each comprised of a linear charge of explosive surrounded by a protective sheath, said low-energy cords being threaded through said rod(s) in the perforations therein, each cord in a different perforation, each of said threaded cords (1) having a section enclosed within the rod(s) in one of said perforations, and (2) leading to an explosive charge in a borehole.

10. An assembly of claim 7, 8, or 9 wherein said low-energy explosive connecting cord is a detonating cord and said linear charge of explosive therein is a continuous solid core of a deformable bonded detonating explosive composition comprising at least about 55 percent by weight of a cap-sensitive crystalline high explosive compound selected from the group consisting of organic polynitrates and polynitramines admixed with a binding agent, the particles of crystalline high explosive compound in said composition having their maximum dimension in the range of about from 0.1 to 50 microns, and the diameter and the explosive content of said core being such as to provide about from 0.1 to 2 grams of crystalline high explosive compound per meter of length of said cord.

11. An assembly of claim 10 wherein said detonating cord trunkline has an explosive loading of at least about 1.5 grams per meter of length.

12. An assembly of claim 7, 8, or 9 wherein said linear charge of explosive in said low-energy explosive connecting cord is a continuous tubular charge applied to the walls of a plastic sheath.

13. A connector for joining a detonating cord trunkline to the explosive booster of claim 1 threaded, or to be threaded, with one or more low-energy explosive connecting cords, said connector comprising a tubular body of rigid plastic material adapted to receive a detonating explosive charge in the form of a rod provided with one or more perforations extending through the entire length, and substantially parallel to the longitudinal axis, thereof, said tubular body having (a) plastic end closures provided with one or more apertures therein coaxial with, and having substantially the same diameter as, the perforation(s) in said rod, and (b) a portion of its wall cut out to allow a trunkline detonating cord to contact the thereby-exposed rod therein, said cut-out portion being circumferential and extending for at least about one-quarter of the circumference of the tubular body, at least one of said end closures being a lid which can be moved into the closed position after the rod has been positioned in the tubular body.

14. A connector of claim 13 including means for maintaining said trunkline detonating cord in contact with the exposed rod in said tubular body.

* * * * *